United States Patent [19]

Turner, Jr.

[11] 4,217,880

[45] Aug. 19, 1980

[54] FIREPLACE INSERT

[76] Inventor: James G. Turner, Jr., 3537 Colgate Ave., Dallas, Tex. 75225

[21] Appl. No.: 816,433

[22] Filed: Jul. 18, 1977

[51] Int. Cl.[2] ..... F24B 7/00

[52] U.S. Cl. ..... 126/131; 126/121

[58] Field of Search ..... 126/121, 131; 237/51

[56] References Cited

U.S. PATENT DOCUMENTS

| | | | |
|---|---|---|---|
| 1,313,085 | 8/1919 | Greene | 126/121 |
| 2,132,563 | 10/1938 | Gallup | 126/121 |
| 2,362,526 | 11/1944 | Austin | 126/121 |
| 2,396,535 | 3/1946 | Rumery | 126/121 |
| 3,190,282 | 6/1965 | Bauer | 126/121 |
| 3,866,595 | 2/1975 | Jones | 126/121 |
| 3,896,785 | 7/1975 | Nelson | 126/121 |
| 3,965,886 | 6/1976 | Nelson | 126/121 |
| 3,995,611 | 12/1976 | Nelson | 126/121 |
| 4,008,707 | 2/1977 | Bartlett | 126/121 X |

FOREIGN PATENT DOCUMENTS

| | | | |
|---|---|---|---|
| 387624 | 7/1908 | France | 126/121 |
| 154709 | 12/1920 | United Kingdom | 126/121 |
| 586739 | 3/1947 | United Kingdom | 126/121 |
| 726983 | 3/1955 | United Kingdom | 126/121 |

*Primary Examiner*—Ronald C. Capossela
*Assistant Examiner*—Harold Joyce
*Attorney, Agent, or Firm*—Richards, Harris & Medlock

[57] ABSTRACT

Air heating apparatus for placement within a conventional fireplace wherein room air is passed through a heat exchanger, warmed by the fire within the fireplace and exhausted back into the room by means of convection transfer. Baffles are provided to force the air to flow through an indirect path and thereby obtain increased contact with the heating surfaces. Heat exchange duct work extends across the back portion of the fireplace to absorb additional heat. Means are provided for adjusting the lateral spacing of heat exchange chambers within the fireplace. Ducts extend the intake and exhaust vents from the heat exchanger apparatus through the frontal plane of the fireplace. Means are provided for controlling the flow of air into and out of each of the vents.

10 Claims, 1 Drawing Figure

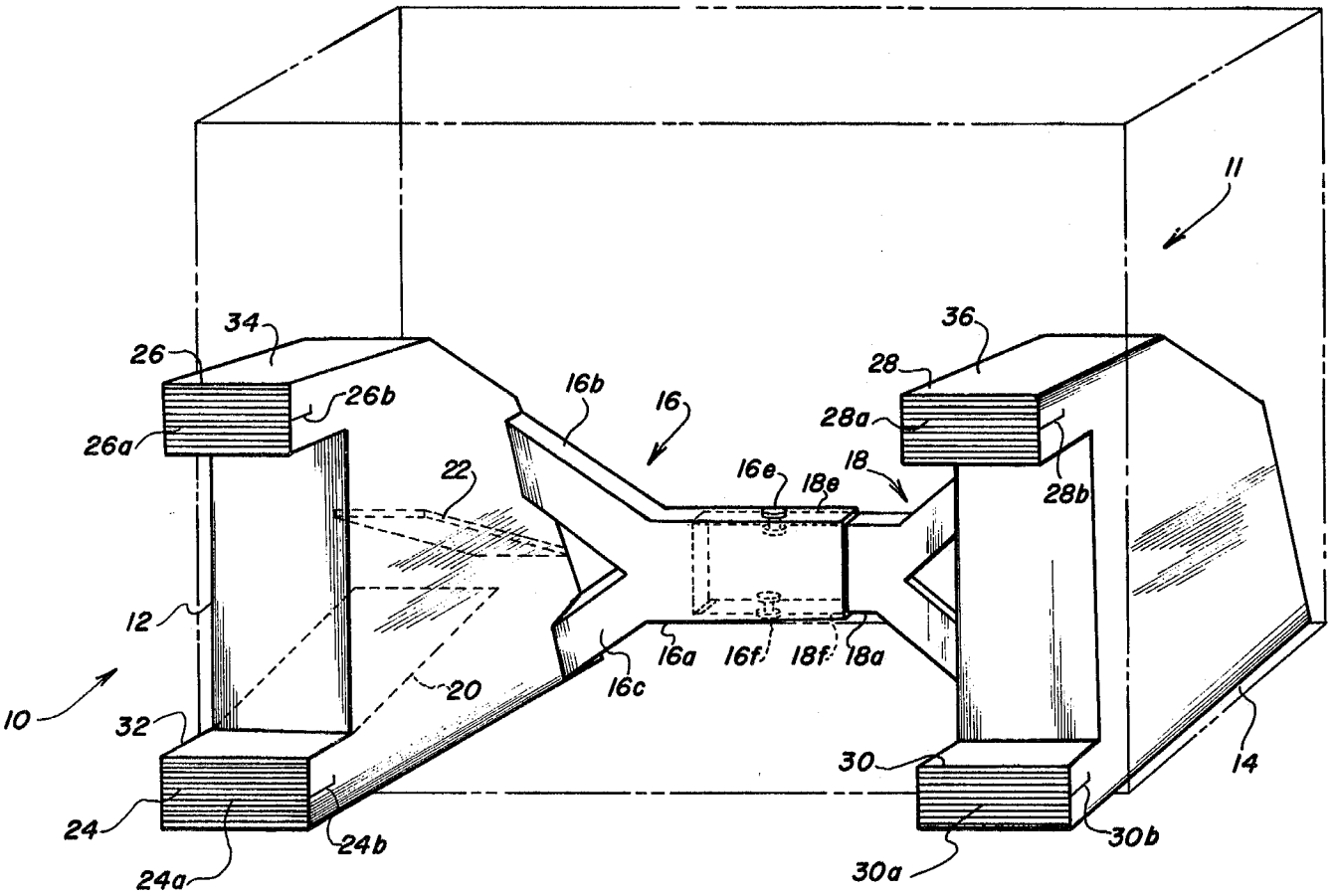
11
14
30b
28b
36
28
28a
18
18e
16e
16
16b
22
26b
34
26
26a
12
10
32
24
24a
24b
20
16c
16a
16f
18f
18a
30
30a

FIREPLACE INSERT

BACKGROUND OF THE INVENTION

The present invention relates to heaters for installation within fireplaces and more particularly to fireplace air heaters which provide flexibility in their installation and in the control of the operation of the device itself.

As a means of providing heat, conventional fireplaces are extremely inefficient since substantially all the heated air is carried up the chimney and lost. Since a conventional fireplace primarily provides radiant heating, apparatus have been proposed for use with fireplaces to warm air in homes. Examples of these devices are disclosed in U.S. Pat. Nos. 2,132,563; 3,190,282; 3,866,595; 3,896,785; 3,965,886; 3,995,611 and 4,008,707.

Although these devices increase the efficiency of the fireplaces, they have not been entirely satisfactory under all conditions of service, especially in the ease and flexibility of installation or in the provision of adequate control and regulation of the heating provided by the device.

Therefore, according to the present invention a fireplace air heater is provided which provides heat transfer on both the sides and back walls of the fireplace, yet is flexible to allow installation in fireplaces of various sizes and shapes. In addition the fireplace heater of the present invention provides control means for regulating the heating provided by the unit itself.

SUMMARY OF THE INVENTION

An air heating apparatus which is placed within a fireplace comprising a pair of chambers spaced apart and contiguous the sides of a fireplace with each chamber having an upper and a lower air vent facing the frontal opening of the fireplace. Means are provided to control the flow through each of the vents. Baffle means are disposed within the chambers to force the air through an indirect path and expose it to a substantial portion of the surface of the heated chambers. Duct work is provided for interconnecting the rear portions of the heat chambers to absorb greater heat and provide slidable adjustable means for varying the lateral spacing of the heat transfer apparatus.

BRIEF DESCRIPTION OF THE DRAWINGS

For a more complete understanding of the present invention and the advantages thereof, reference is now made to the following description taken in conjunction with the FIGURE which shows an isometric view of the present invention.

DETAILED DESCRIPTION OF THE PREFERRED EMBODIMENT

In the FIGURE there is shown an air heating apparatus 10 in accordance with the present invention positioned in a fireplace 11 shown in phantom lines. The apparatus comprises a first chamber 12 and a second chamber 14 interconnected by a first duct member 16 and a second duct member 18.

Chamber 12 is comprised of an intake vent 24 covered by a louver **24*a* which is operated by a lever 24*b*. The louver and control mechanism provide means for adjusting the rate of flow of air through the vent. A duct 32 extends from the chamber 12 to vent 24**.

An exhaust vent 26 for the chamber 12 is covered by a louver **26*a* which is operated by a lever 26*b*. The louver is mounted on the end of a duct 34** extending forward or toward the front of the fireplace as shown.

An upper baffle 22 extends across the interior of chamber 12 and is joined to the back and side walls of chamber 12. A lower baffle 20 likewise extends across the interior of chamber 12 and is joined to the front and side walls.

The chamber 14 is constructed in the same manner and comprises the same components as the chamber 12 except that it is a mirror image thereof.

The chambers 12 and 14 are connected at their rear portions by duct members 16 and 18. The duct member 16 is comprised of a horizontal duct member **16*a* joined to an outlet duct 16*b* and an inlet duct 16*c*. Ducts 16*b* and 16*c* are joined to chamber 12 and are in fluid communication therewith. Retainer screws 16*e* and 16*f* pass through the horizontal duct member 16*a***.

The duct member 18 includes a horizontal duct member **18*a*, an outlet duct 18*b* and an inlet duct 18*c*. Ducts 18*b* and 18*c* are joined to chamber 14 and are in fluid communication therewith. The horizontal member 18*a* contains horizontal slots 18*e* and 18*f* which align respectively with retainer screws 16*e* and 16*f* in duct member 16**.

To install the heating apparatus 10 of the present invention, the chambers 12 and 14 are positioned in fireplace 11 and are laterally adjusted to be adjacent the walls of the fireplace to fill the full width thereof. This adjustment is accomplished by telescoping duct member 18 within duct member 16. After the unit is aligned within the fireplace the retainer screws **16*e* and 16*f* are tightened to rigidly join together the two chambers 12 and 14**.

Combustible material is placed within the center of the fireplace and ignited so that the resulting flame heats chambers 12 and 14 as well as duct members 16 and 18. Heat is transferred to the air within the apparatus 10 thereby causing the air to rise and pass through the exhaust vents 26 and 28. Air within the duct members 16 and 18 is also heated and caused to rise through the sections **16*b* and 18*b* into the respective chambers and out the vents 26 and 28. As the warm air passes through the exhaust vents, a partial vacuum is created and room air is pulled in through the intake vents 24 and 30. The room air being brought into the heating chambers is drawn in from floor level and is therefore cooler than the air being exhausted back into the room. The air entering the chambers 12 and 14 is then heated whereby it rises and passes through the exhaust vents into the room. The baffles 20 and 22 force the incoming air to take an indirect path between the inlet and exhaust vents thereby exposing the air to more of the surface of the heating chambers 12 and 14**. This process causes the air to absorb more heat and reach a higher temperature.

The louvers and controls on each of the vents can be used to control the rate of flow of air through the heating chambers and thereby control the amount of warm air that is provided to the room. In addition circulation between the two chambers 13 and 14 can be controlled by selectively adjusting the louvers. If desired, the louvers can be fully closed to completely shut off the flow of warm air.

The air heating apparatus 10 is constructed of a suitable material that is a good heat conductor, is sufficiently strong to withstand the loading of logs into the fireplace and is relatively resistent to corrosion. Suitable metallic materials which meet these requirements are steel, iron and aluminum.

It is to be understood, of course, that the foregoing relates only to a preferred embodiment of the invention and that numerous alterations may be utilized to practice the present invention without departing from the spirit and scope of the invention as defined in the appended claims.

What is claimed is:

1. An air heating apparatus for placement within a fireplace, comprising:

(a) a pair of chambers each chamber comprising:
  (i) two vertically disposed side panels,
  (ii) front and rear panels narrower than said side panels and joined to said side panels,
  (iii) horizontally disposed top and bottom panels joined to said side, front and rear panels,
  (iv) a first vent disposed near the bottom of said front panel,
  (v) a second vent disposed near the top of said front panel,
  (vi) a first baffle disposed within said chamber, joined to said front panel above said first vent, joined to said side panels, and inclined upward away from said front panel, said first baffle stopping short of said rear panel,
  (vii) a second baffle disposed within said chamber joined to said rear panel at a point lower than said second vent, joined to said side panels, and inclined upward away from said rear panel with the end of said second baffle opposite said rear panel positioned above said first baffle and stopping short of said front panel, (b) a pair of Y-shaped ducts joined in fluid communication to each other through horizontally disposed members with one duct joined in fluid communication to each chamber comprising:
  (i) an upward disposed duct member connected to the rear, upper portion of said chamber above the point of connection of said second baffle to said rear panel,
  (ii) a downward disposed duct member connected to the rear, lower portion of said chamber below the point of connection of said second baffle to said rear panel, (c) means in said horizontally disposed members for permitting the lateral adjustment of said members so that the spacing between said chambers may be varied.

2. An air heating apparatus for placement within a fireplace as recited in claim 1, including ducts integral to said chambers and extending said vents from said chambers to the frontal opening of said fireplace.

3. Air heating apparatus for placement within a fireplace, comprising:

(a) a pair of chambers spaced apart for positioning adjacent to the sides of said fireplace, each chamber being defined by inner and outer side panels joined to top, bottom, front, and rear panels with the front panel of each chamber having an upper air vent and a lower air vent therein;

(b) a first inclined baffle disposed within each of said chambers between the air vents, said first baffle extending from the front panel toward the rear panel but stopping short of the rear panel in each chamber;

(c) a second inclined baffle disposed within each of said chambers between the air vents, said second baffle extending from the rear panel over said first baffle and toward the front panel but stopping short of the front panel in each chamber;

(d) cross duct means joined between the inner panels of the chambers adjacent to the rear panels thereof for connecting in fluid communication said chambers, said cross duct means including V-shaped ends connected to said chambers across the second incline baffles therein.

4. Apparatus as recited in claim 3 including adjustable louvers covering said vents.

5. Apparatus as recited in claim 3 wherein said cross duct means comprises;

(a) a first member having a horizontal duct which is joined to a first upward disposed duct and to a first downward disposed duct, said first upward and said first downward disposed ducts being joined to the inner panel of one of said chambers, (b) a second member having a horizontal duct slidably joined to the horizontal duct of said first member and joined to a second upward disposed duct and to a second downward disposed duct, said second upward and said second downward disposed ducts being joined to the inner panel of the other one of said chambers, and (c) means for fixing said first member relative to said second member.

6. A fireplace air heating apparatus comprising:

(a) a pair of chambers for insertion into a fireplace adjacent to the sides of the fireplace, said chambers having side panels joined to and maintained in spaced relation by front and rear panels;

(b) upper and lower vents communicating with the front panel of each of said chambers;

(c) a first baffle disposed within each said chamber, said first baffle being joined to said front panel above said lower vent, attached to said side panels and inclined upwardly away from the front panel and stopping short of said rear panel;

(d) a second baffle disposed within each said chamber, said second baffle being joined to said rear panel at a point below said second vent, attached to said side panels and inclined upwardly away from said rear panel with the end of said second baffle opposite said rear panel positioned above said first baffle and stopping short of said front panel; and (e) a pair of Y-shaped ducts joined in fluid communication to each other and to each of said chambers, each said Y-shaped duct including an upward disposed duct member connected to the rear, upper portion of said chamber above the point of connection of said second baffle to said rear panel and a downward disposed duct member connected to the rear, lower portion of said chamber below the point of connection of said second baffle to said rear panel.

7. A fireplace air heating apparatus as recited in claim 6 including ducts integral to said chambers that extend said vent through the frontal opening of said fireplace.

8. A fireplace air heating apparatus as recited in claim 6 wherein said means operatively associated with each of said vents is a louver.

9. A fireplace air heating apparatus as recited in claim 6 wherein said duct means are lengthwise adjustable to allow adjustment of the lateral spacing of said chambers.

10. A fireplace air heating apparatus as recited in claim 6 wherein said duct means comprises:

(a) a first member having a horizontal duct which is joined to a first upward disposed duct and to a first downward disposed duct, said first upward and said first downward disposed ducts joined to the rear portion of a first of said chambers, (b) a second member having a horizontal duct slidably joined to the horizontal duct of said first member and joined to a second upward disposed duct and to a second downward disposed duct, said second upward and said second downward disposed ducts joined to the rear portions of a second of said chambers, and (c) means for fixing said first member relative to said second chamber.

* * * * *